US006817901B2

(12) United States Patent
Nishide

(10) Patent No.: US 6,817,901 B2
(45) Date of Patent: Nov. 16, 2004

(54) CONNECTOR

(75) Inventor: Satoru Nishide, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/406,093

(22) Filed: Apr. 2, 2003

(65) Prior Publication Data

US 2003/0207616 A1 Nov. 6, 2003

(30) Foreign Application Priority Data

Apr. 5, 2002 (JP) ..... 2002-104399

(51) Int. Cl.[7] ..... H01R 13/40
(52) U.S. Cl. ..... 439/595; 439/474; 439/852
(58) Field of Search ..... 439/595–596, 439/852, 157, 474

(56) References Cited

U.S. PATENT DOCUMENTS 5,645,452 A 7/1997 Kodama
5,928,034 A * 7/1999 Tabata et al. ..... 439/595
6,126,484 A * 10/2000 Klein et al. ..... 439/595
6,149,462 A * 11/2000 Sugie ..... 439/595
6,334,790 B2 * 1/2002 Kashiyama et al. ..... 439/595
6,386,904 B2 * 5/2002 Sasaki et al. ..... 439/488
6,582,242 B2 * 6/2003 Murakami et al. ..... 439/271
6,623,313 B1 * 9/2003 Ichida et al. ..... 439/752.5
6,626,701 B2 * 9/2003 Yoshida et al. ..... 439/595

FOREIGN PATENT DOCUMENTS

| | | |
|---|---|---|
| EP | 1 032 080 | 8/2000 |
| JP | 05-047433 | 2/1993 |
| JP | 6-325814 | 11/1994 |

* cited by examiner

*Primary Examiner*—Truc Nguyen
(74) *Attorney, Agent, or Firm*—Gerald E. Hespos; Anthony J. Casella

(57) ABSTRACT

A connector housing (10) has a terminal accommodating portion (11) with cavities (13) at upper and lower stages, and locks (21) project respectively into each cavity (13). Each lock (21) has a resiliently deformable arm (22) and a locking section (23) engageable with a female terminal fitting (30). A retainer (40) is mounted on the terminal accommodating portion (11) and has deformation restricting portions (44) that enter deformation spaces (24) for the locks (21) to prevent deformation of the locks (21). Each arm (22) has an engaging portion (29). Engaging portions (29B) at the lower stage engage a side wall (25A) of the cavity (13A) at the upper stage during the deformation of the lock (21B). Engaging portions (29A) at the upper stage engage a surrounding wall (41) of the retainer (40) during deformation of the lock (21A). Thus, the locks (21) cannot deform beyond their resiliency limit.

11 Claims, 10 Drawing Sheets

CONNECTOR

BACKGROUND OF THE INVENTION

1. Field of the Invention

The invention relates to a connector with locks.

2. Description of the Related Art

Japanese Unexamined Patent Publication No. 6-325814 and FIG. 10 herein disclose a multi-stage connector with locks for locking terminal fittings. The connector shown in FIG. 10 includes a housing 1 and terminal fittings 2 that are received in cavities 3 formed in the housing 1. Deformation permitting spaces 4 are disposed near the cavities 3 and resiliently deformable locks 5 are disposed between the cavities 3 and the deformation permitting spaces 4. The terminal fittings 2 are insertable from behind into the cavities 3 and press the locks 5. As a result, the locks 36 deform resiliently into the corresponding deformation permitting spaces 4 located above. The locks 5 then return to engage and lock the terminal fittings 2 when the terminal fittings 2 reach proper depth in the respective cavity 3. Excessive deformation preventing walls 6 are provided above the deformation permitting spaces 4 in the housing 1 for preventing the locks 5 from deforming beyond their resiliency limit.

Japanese Unexamined Patent Publication No. 5-47433 and FIG. 11 herein disclosed a connector with a front retainer for increasing a holding force on terminal fittings by restricting the resilient deformation of locks. As shown in FIG. 11, the connector has a housing 1 and terminal fittings 2 are received in cavities 3 of the housing 1. Deformation spaces 4 are provided near the cavities 3 and resiliently deflectable locks 5 are between the cavities 3 and the deformation spaces 4. Deformation preventing walls 6 are formed adjacent the deformation spaces 4 to prevent the locks 5 from deforming beyond their resiliency limit. Collectively, the cavities 3, deformation spaces 4, locks 5 and excessive deformation preventing walls 6 define a terminal-accommodating portion 7. The connector of FIG. 11 also has a front retainer 8 mounted on the front of the terminal-accommodating portion 7. The front retainer 8 has resilient deformation restricting portions 8*a* that enter the deformation spaces 4 to restrict the deformation of the locks 5 engaged with terminal fittings 2. The front retainer 8 has a surrounding wall 8*b* for surrounding the outer peripheral surface of the terminal accommodating portion 7.

The locks 5, the deformation spaces 4 and the excessive deformation preventing walls 6 are arranged one over another along the height of the connector of FIG. 10. On the other hand, the locks 5, the deformation spaces 4, the excessive deformation preventing walls 6 and the surrounding wall 8*b* of the front retainer 8 are arranged one over another along height of the connector of FIG. 11. Thus, the connectors shown in FIGS. 10 and 11 are undesirably tall.

The present invention was developed in view of the above problem and an object thereof is to miniaturize a connector.

SUMMARY OF THE INVENTION

The invention relates to a connector with a housing formed with cavities for receiving terminal fittings. Locks project into the corresponding cavities. Each lock is deformed during insertion of the terminal fitting and returns resiliently to lock the terminal fitting when the terminal fitting reaches proper depth. The cavities are arranged at a plurality of stages along the deforming direction of the locks. Each lock has an engaging portion that projects at an angle to the deforming direction and faces a side wall of the cavity located before the lock with respect to the resilient deforming direction. The side wall extends along the resilient deforming direction. Each engaging portion is received by the corresponding side wall to prevent excessive deformation of the corresponding lock. As a result, the connector can be miniaturized with respect to the resilient deforming direction of the locks as compared to a case where excessive deformation preventing walls are provided between locks and cavities before them with respect to the resilient deforming direction, as in the prior art.

The connector preferably further comprises a retainer displaceable between a first position, where the terminal fittings are insertable into the cavities, and a second position, where the retainer engages the locks for doubly locking the terminal fittings in the cavities.

The retainer preferably is mounted from the front and comprises a surrounding wall for surrounding the outer peripheral surface of the housing.

The engaging portion of at least one lock may face the surrounding wall, and may engage the surrounding wall to prevent the corresponding lock from undergoing an excessive deformation.

The engaging portions project in directions that intersect the resilient deforming direction of the lock and are received by the surrounding wall of the retainer or the deformation restricting portion to prevent excessive deformation of the lock. Thus, the connector can be miniaturized with respect to the resilient deforming direction of the locks as compared to a case where the deformation restricting portions and the surrounding wall of the front retainer are arranged one over the other along the resilient deforming direction of the locks as in the prior art.

Each engaging portion preferably is coupled to the corresponding lock substantially over the entire length of the lock.

The locks can be reinforced by the engaging portions.

The engaging portion can interact with a jig inserted into the housing to deflect the lock in the deforming direction.

The retainer preferably comprises a front wall formed with mating terminal fitting insertion holes for permitting insertion of mating terminal fittings into the cavities and jig insertion holes for receiving a jig for forcibly deforming the lock in the deforming direction to withdraw the terminal fitting. The insertion holes are displaced along the height and/or width directions of the connector.

The retainer preferably comprises a support for supporting a front portion of the terminal fitting(s) so as not to shake.

A seal ring preferably is provided on the housing to provide watertightness between the connector and a mating connector. The seal ring preferably can be held by the surrounding wall so as not to come out.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A multi-stage female connector according to the invention is illustrated in FIGS. 1 to 9. The connector includes opposite front and rear ends as illustrated respectively at the left and right sides of FIGS. 3 and 4. The front end of the connector is configured for connection with a mating connector.

Figure 1:
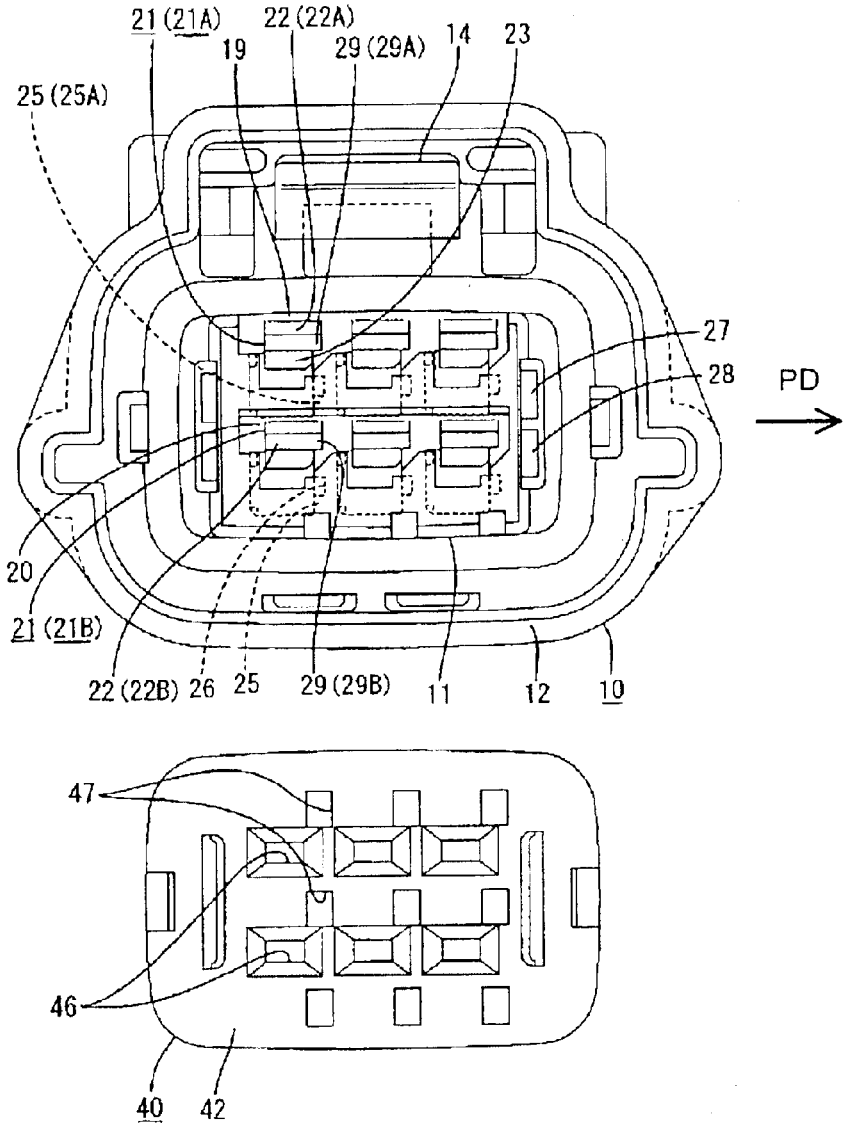
FIG. 1 is a front view of a housing and a front retainer according to one embodiment of the invention.
Figure 3:
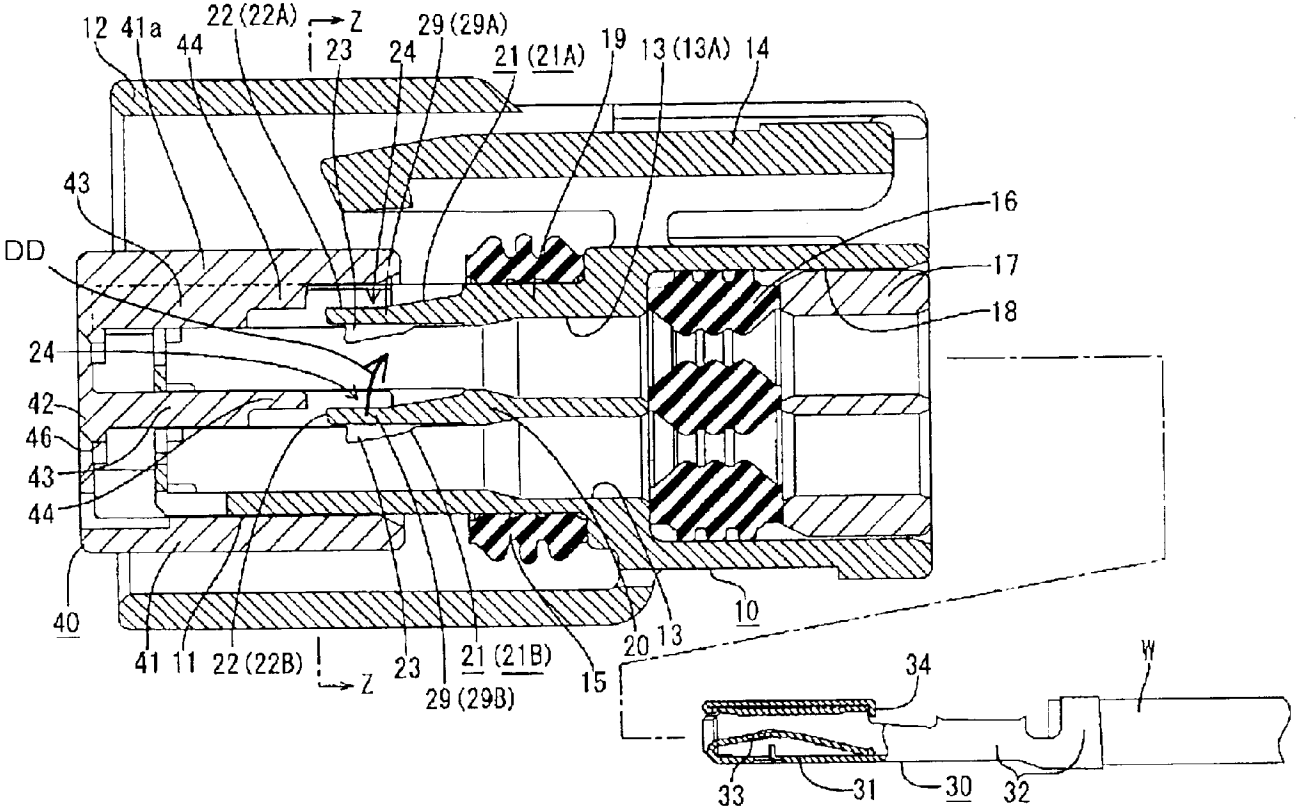
FIG. 3 is a section along 3—3 of FIG. 2 showing a state where the front retainer is mounted at a partial locking position in the housing.

The connector includes a housing 10 made e.g. of a synthetic resin. The housing 10 has a terminal accommodating portion 11 and a forwardly open outer tube 12 that is coupled to the outer peripheral surface of the terminal accommodating portion 11, as shown in FIGS. 1 and 3. The terminal accommodating portion 11 is formed with cavities 13 that extend between the front and rear ends of the housing 10. A mating male connector (not shown) is fittable from the front into the space between the terminal accommodating portion 11 and the outer tube 12. A cantilevered lock arm 14 projects from the upper surface of the terminal accommodating portion 11 for locking the male and female connectors together. A seal ring 15 is mounted on the outer periphery of the terminal accommodating portion 11 at a position immediately before the lock arm 14 to provide a watertight fit between the male connector and the housing 10. A one-piece rubber plug 16 and a press 17 are provided one after the other in an accommodating recess 18 at the rear of the terminal accommodating portion 11. The rubber plug 16 prevents water from entering the respective cavities 13 and the press 17 holds the rubber plug 16 in place. The rubber plug 16 and the press 17 each are formed with wire insertion holes through which wires W can be drawn.

Cavities 13 are arranged in a widthwise direction at upper and lower stages in the terminal accommodating portion 11. Upper walls 19 of the cavities 13 at the upper stage and partition walls 20 that partition the upper and lower cavities 13 are cut off from the front end of the terminal accommodating portion 11 to a longitudinal intermediate position. Locks 21 are cantilevered forwardly from the front ends of the upper walls 19 and the partition walls 20 in the respective cavities 13. Each lock 21 has a forward-extending arm 22 and a locking section 23 that projects into the cavity 13 from the bottom inward end of the arm 22. The arm 22 projects more forward than the locking section 23 and is resiliently deformable upward into a deformation space 24 (see FIG. 6). The rear surface of the locking section 23 is slanted so that the resilient deformation of the arm 22 can be guided, whereas the front surface thereof is undercut.

Figure 9:
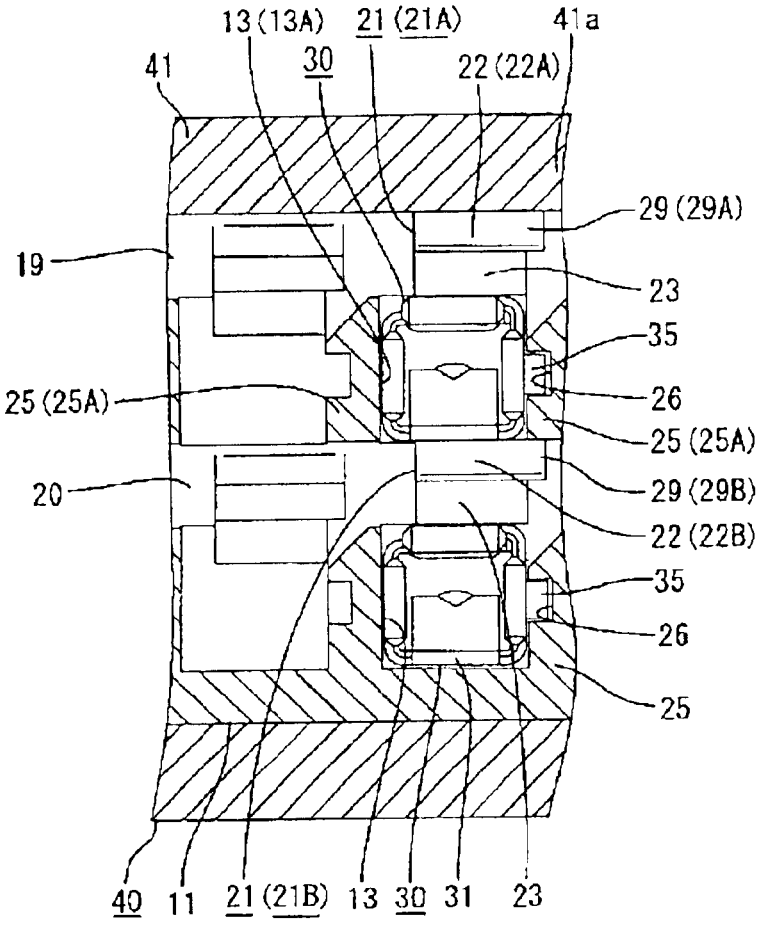
FIG. 9 is a section similar to FIG. 5, but showing a state where the excessive resilient deformation of locking portions is prevented.

The connector also includes female terminal fittings 30 disposed respectively in the cavities 13. Each female terminal fitting 30 is press-formed of a conductive metallic plate and has a rectangular tubular main portion 31. A resilient contact piece 33 is formed inside the main body 31 and is configured for resiliently contact with a male terminal fitting (not shown). Barrels 32 are formed at the end of the female terminal fitting 30 opposite the main body 31 and are configured to be crimped, bent or folded into connection with an end of the wire W. A jaw 34 is formed at the upper rear end of the main portion 31 and is engageable by the locking section 23 of the lock 21. Further, as shown in FIG. 9, a stabilizer 35 projects from the right side surface of the main portion 31 and is insertable into an insertion groove 26 formed in a right side wall 25 of the cavity 13.

The connector also includes a retainer 40 made e.g. of a synthetic resin and mountable onto the terminal accommodating portion 11 from the front. The retainer 40 has a rectangular tubular surrounding wall 41 and a front wall 42. The surrounding wall 41 substantially surrounds the outer peripheral surface of the terminal accommodating portion 11, while the front wall 42 covers the front surface of the terminal accommodating portion 11, as shown in FIGS. 1 and 3. Support walls 43 project back from the front wall 42 and can enter the front spaces of the respective upper and lower locks 21 in the housing 10 as defined by cutting off portions of the upper walls 19 and the partition walls 20. The support walls 43 support the female terminal fittings 30 inserted into the respective cavities 13. A deformation restricting portion 44 projects back from each support wall 43 and enters the deformation space 24 for the lock 21 to restrict the resilient deformation of the lock 21. The deformation restricting portions 44 have a thickness which is about half the thickness of the support walls 43.

Figure 4:
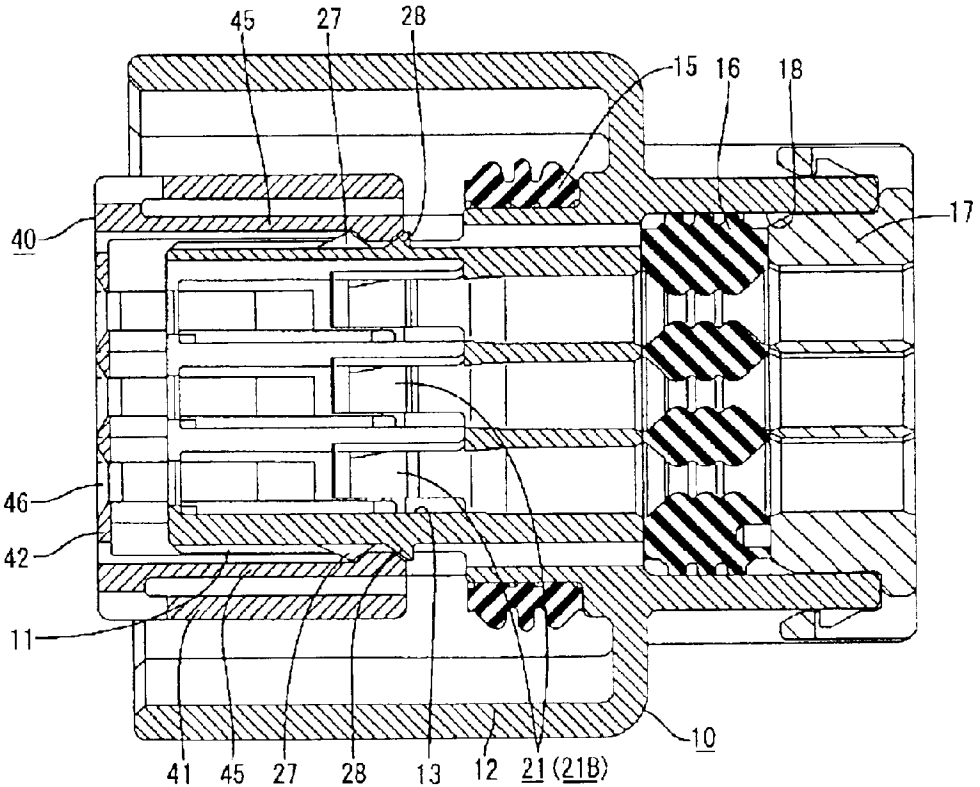
FIG. 4 is a section along 4—4 of FIG. 2 showing the state where the front retainer is mounted at the partial locking position in the housing.
Figure 7:
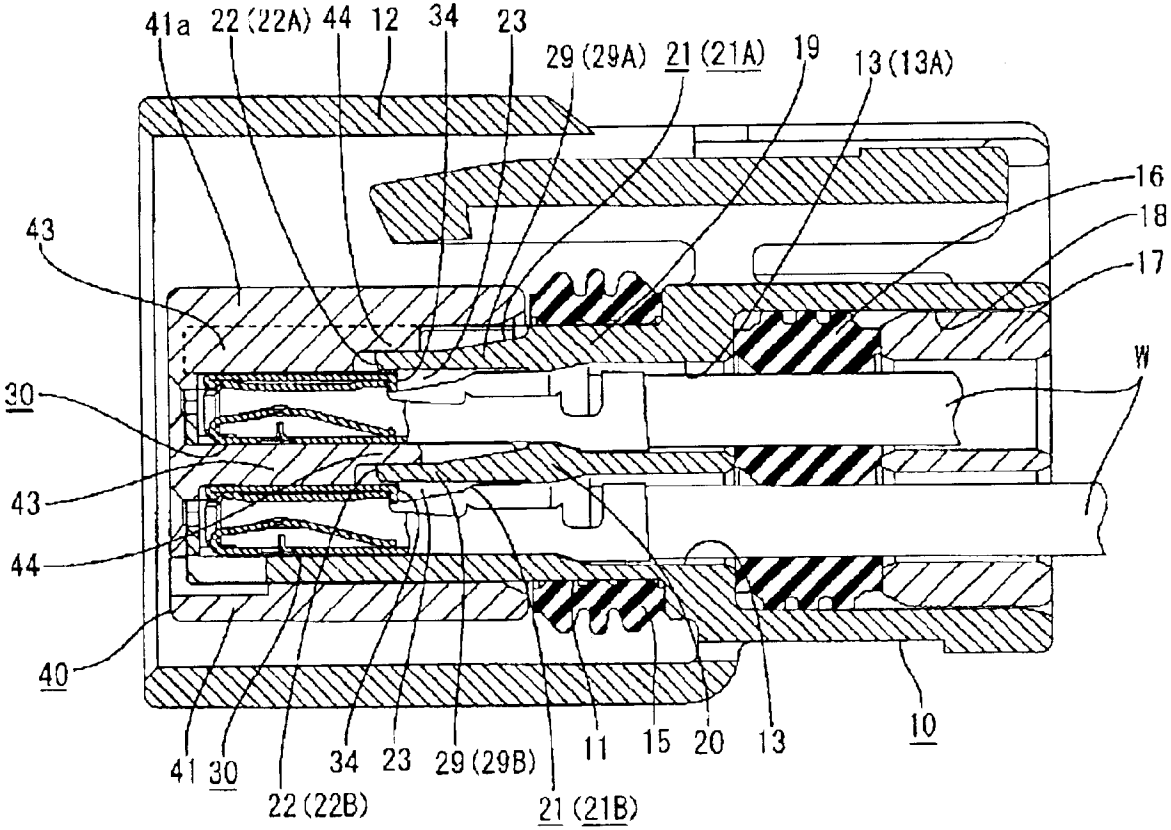
FIG. 7 is a section similar to FIG. 3 showing a state where the female terminal fittings are properly inserted in the cavities and the front retainer is mounted at a full locking position in the housing.

The retainer 40 is movable forward and back along a moving direction with respect to the terminal accommodating portion 11 between a partial locking position (see FIG. 3) and a full locking position (see FIG. 7). The deformation restricting portions 44 are before the deformation spaces 24 for the locks 21 when the retainer 40 is in the partial locking position (FIG. 3) to permit deformation of the locks 21. However, the deformation restricting portions 44 enter the deformation spaces 24 when the retainer 40 is in the full locking position (FIG. 7) to prevent the locks 21 from being deformed. As shown in FIG. 4, holding arms 45 are cantilevered from opposite sides of the surrounding wall 41 of the retainer 40. The retainer 40 can be held selectively on the terminal accommodating portion 11 at the partial locking position (FIG. 4) and the full locking position (FIG. 8) by the engagement of the holding arms 45 with partial locking projections 27 and full locking projections 28 that project from the outer side surfaces of the terminal accommodating portion 11.

Figure 2:
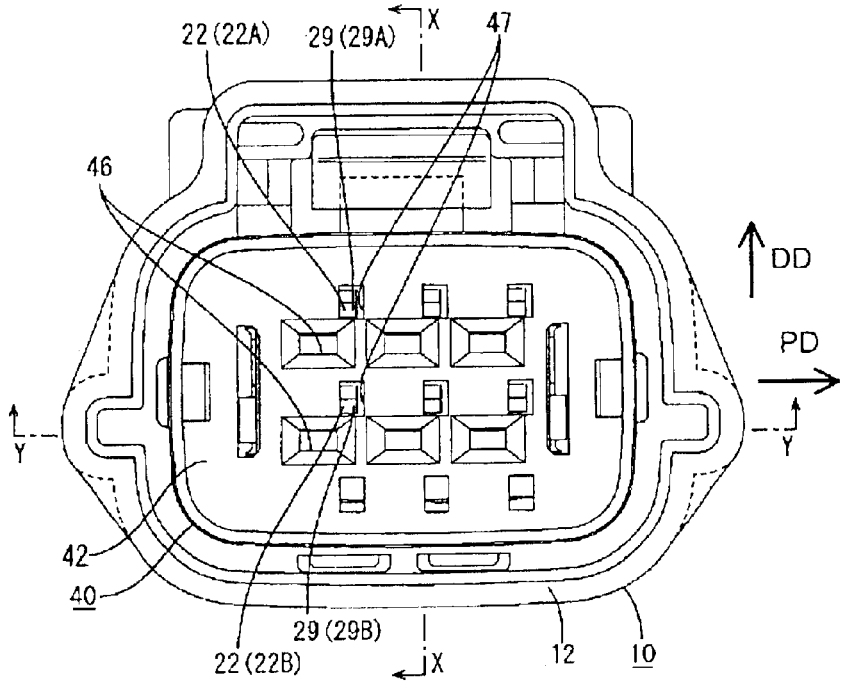
FIG. 2 is a front view showing a state where the front retainer is mounted in the housing.

The front wall 42, as shown in FIG. 2, has male terminal fitting insertion holes 46 for permitting insertion of the male terminal fittings into the cavities 13. The front wall 42 also has jig insertion holes 47 for permitting insertion of a jig for deforming the lock 21 in the deforming direction DD so that the female terminal fitting 30 can be withdrawn. The insertion holes 46 and 47 are displaced along height and width directions. Further, as shown in FIG. 3, the surrounding wall 41 holds the seal ring 15 and prevents the seal ring 15 from coming out forward.

As shown in FIG. 1, an engaging portion 29 projects from the right side surface of the arm 22 of each lock 21. More particularly, the engaging portion 29 projects to the right in a projecting direction PD which intersects the deforming direction DD. Each engaging portion 29 and the right front end of the corresponding arm 22 are exposed at the front through the corresponding jig insertion hole 47 of the retainer 40, as shown in FIG. 2, and can be pressed by the jig inserted into the jig insertion hole 47. In the following description, the suffix A is attached to the reference numbers of the cavities 13, the locks 21 and the engaging portions 29 at the upper stage, while the suffix B is attached to the reference numerals at the lower stage to distinguish these elements at the upper and lower stages. No suffix is attached to refer to these elements collectively.

Figure 5:
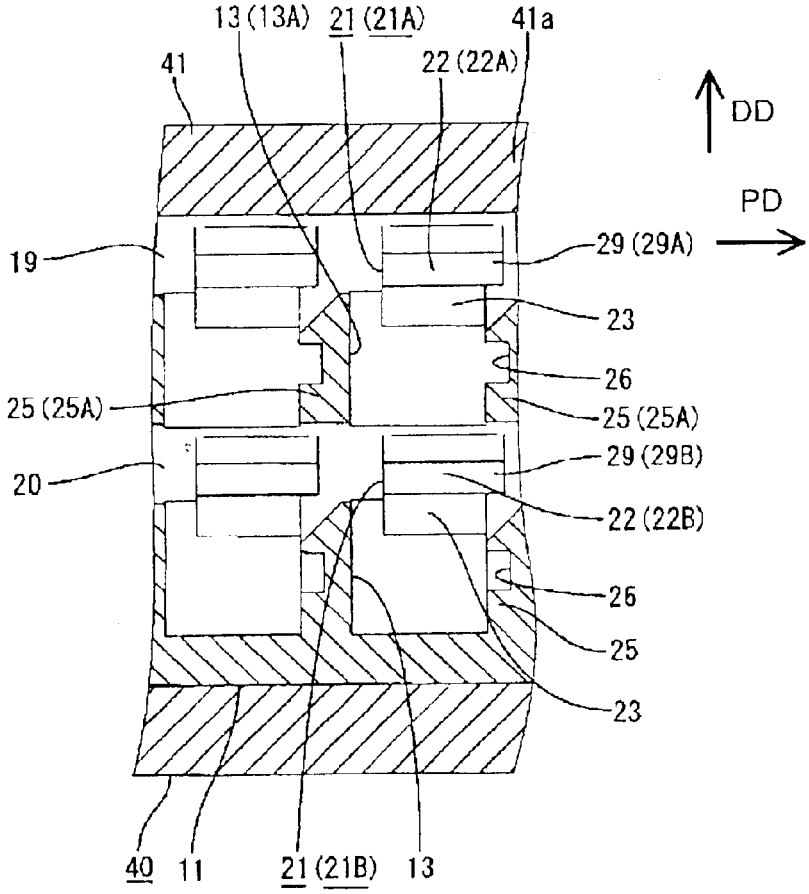
FIG. 5 is a section along 5—5 of FIG. 3.

As shown in FIGS. 3 and 5, each engaging portion 29A at the upper stage is coupled to the arm 22A over substantially the entire length of the arm 22A and to the front end surface of the upper wall 19. Each engaging portion 29B at the lower stage is coupled to the arm 22B over substantially the entire length of the arm 22B and to the front end surface of the partition wall 20. Thus, the locks 21A, 21B are reinforced. The engaging portions 29A at the upper stage face an upper portion 41*a* of the surrounding wall 41 when the front retainer 40 is at the partial locking position, whereas the engaging portions 29B at the lower stage face corresponding right side walls 25A of the cavities 13A at the upper stage shown in FIG. 5. The side walls 25A extend substantially vertically along the resilient deforming direction DD of the locks 21. Deformation of the lock 21A at the upper stage in the deforming direction DD brings the engaging portion 29A into engagement with the upper portion 41*a* of the surrounding wall 41 before the lock 21A is deformed beyond its resiliency limit. Deformation of the lock 21B at the lower stage brings the engaging portion 29B into engagement with the lower surface of the side wall 25A before the lock 21B is deformed beyond its resiliency limit. In this way, the locks 21*a*, 21B are prevented from undergoing a plastic deformation. Thus, the upper portion 41*a* of the surrounding wall 41 of the retainer 40 forms an excessive deformation preventing portion for the locks 21A at the upper stage, and the side walls 25A of the cavities 13 at the upper stage form excessive deformation preventing portions for the locks 21B at the lower stage.

As shown in FIGS. 3 and 4, the seal ring 15, the one-piece rubber plug 16 and the press 17 are mounted into the housing 10, and the respective female terminal fittings 30 are inserted into the corresponding cavities 13 with the retainer 40 mounted at the partial locking position.

Figure 6:
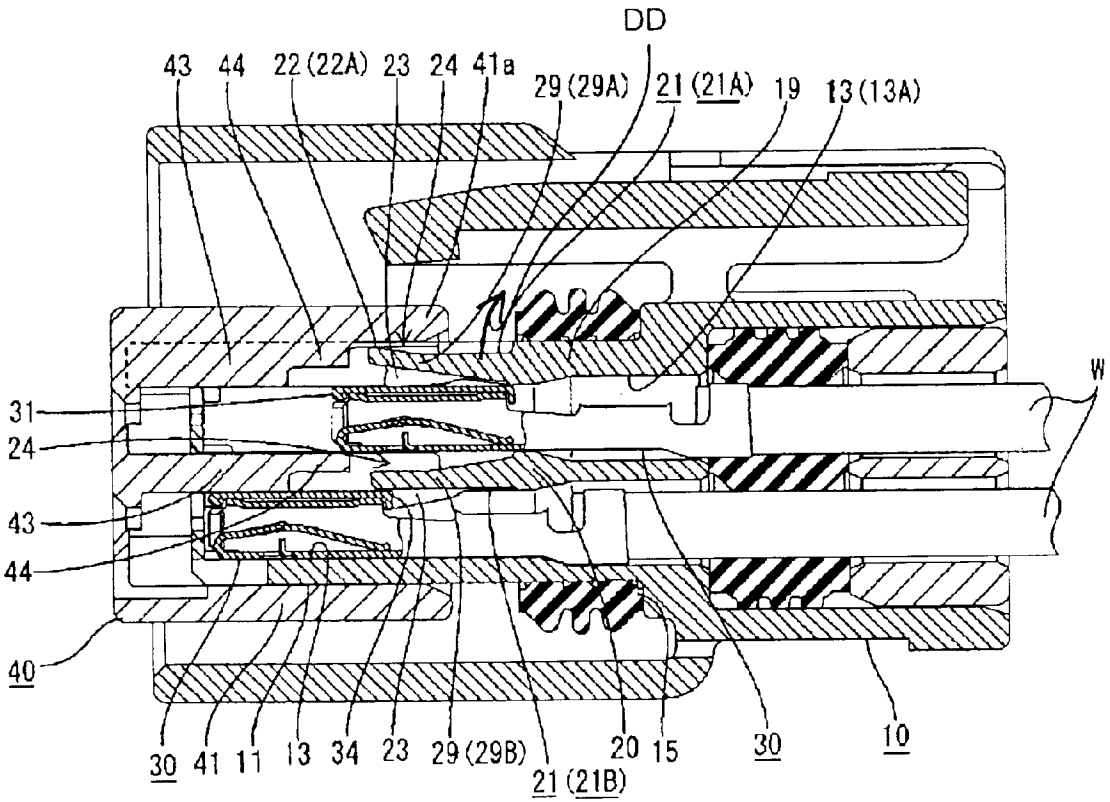
FIG. 6 is a section similar to FIG. 3, but showing an intermediate stage of insertion of female terminal fittings into cavities.

The main portion 31 of the female terminal fitting 30 pushes the rear surface of the locking section 23 of the arm 22 during the insertion of the female terminal fitting 30 into the cavity 13. Thus, the arm 22 deforms resiliently up and into the deformation space 24, as shown in FIG. 6. This inserting operation is guided smoothly as the stabilizer 35 is inserted into the insertion groove 26 (see FIG. 9). The arm 22 resiliently returns when the female terminal fitting 30 is inserted to proper depth in the cavity 13 and the front surface of the locking section 23 engages the jaw 34. Thus, the female terminal fitting 30 is held so as not to come out of the cavity 13. At this stage, the front half of the main portion 31 of the female terminal fitting 30 is supported by the supporting wall 43 of the front retainer 40 so as not to shake vertically.

Figure 8:
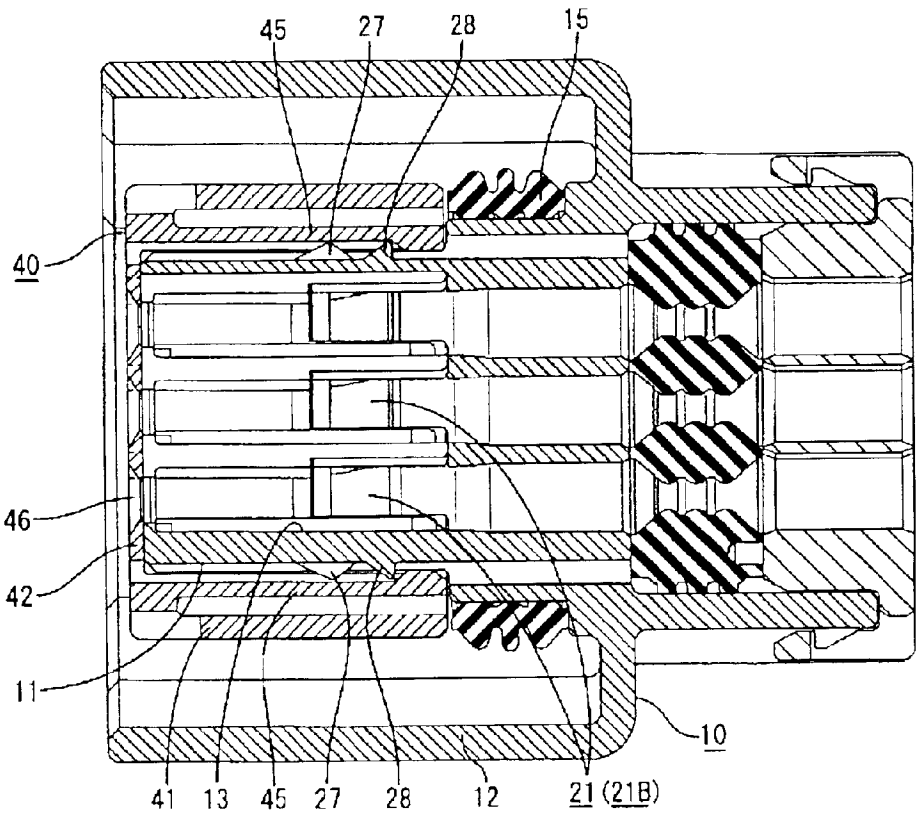
FIG. 8 is a section similar to FIG. 4, but showing a state where the front retainer is mounted at the full locking position in the housing.

The retainer 40 is pushed from the partial locking position to the full locking position after the insertion of all the female terminal fittings 30 is completed. The respective support walls 43 support substantially the entire main portions 31 except their rear ends when the front retainer 40 reaches the full locking position, and the respective deformation restricting portions 44 enter the corresponding deformation spaces 24, as shown in FIGS. 7 and 8. This prevents the locks 21 from being inadvertently deformed. As a result, the female terminal fittings 30 can be held more strongly so as not to come out.

The female terminal fitting 30 may have to be withdrawn for maintenance or other reason. In such a case, the front retainer 40 is returned to the partial locking position to retract the deformation restricting portions 44 forward from the deformation spaces 24. The jig then is inserted into the jig insertion hole 47 from front (see FIG. 2) and is used to deform the lock 21 forcibly by pushing the front ends of the arm 22 and the engaging portion 29 in the deforming direction DD. The female terminal fitting 30 then is pulled out of the cavity 13 after the locking section 23 is disengaged from the jaw 34.

The force exerted on the jig may be sufficiently large to deform the lock 21 excessively during the withdrawing operation. However, an excessive force on the lock 21A at the upper stage will urge the engaging portion 29A into the upper portion 41*a* of the surrounding wall 41 of the retainer 40, as shown in FIG. 9, to prevent the lock 21A from being deformed beyond its resiliency limit. On the other hand, an excessive force on the lock 21B at the lower stage will urge the engaging portion 29B into the lower surface of the right side wall 25A of the cavity 13A at the upper stage shown in FIG. 9 to prevent the lock 21B from being deformed beyond its resiliency limit. Each lock 21 is prevented from undergoing a plastic deformation. Therefore, the female terminal fitting 30 is locked secure when the withdrawn female terminal fitting 30 is inserted again into the cavity 13.

Figure 10:
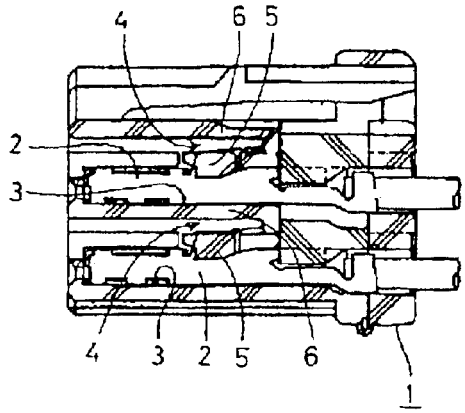
FIG. 10 PRIOR ART
FIG. 10 is a section of a prior art connector.

As described above, the engaging portion 29B is provided on the side surface of each lock 21B at the lower stage. Each engaging portion 29B projects in a direction PD that intersects the resilient deforming direction DD and faces the side wall 25A of the cavity 13A at the upper stage which extends in the resilient deforming direction DD. The engaging portion 29B interacts with the side wall 25A to prevent the excessive deformation of the lock 21B. Thus, the connector can be miniaturized with respect to the resilient deforming direction DD of the locks 21, as compared to a case where the excessive deformation preventing walls are provided between the lock and the cavities at the upper stage as in the prior art connector shown in FIG. 10.

Figure 11:
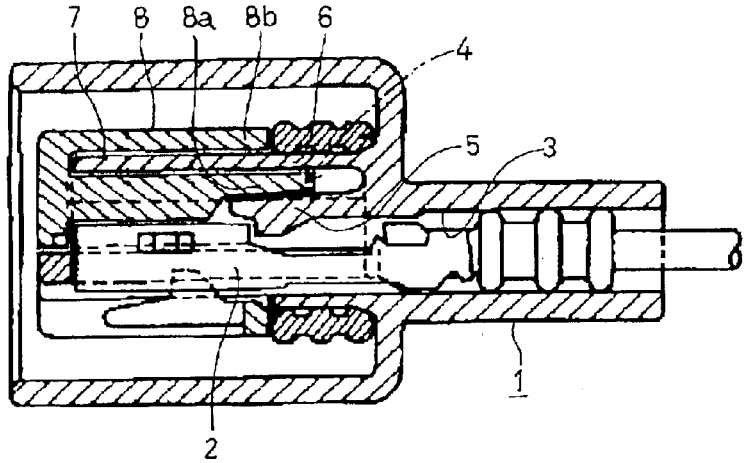
FIG. 11 PRIOR ART
FIG. 11 is a section of another prior art connector.

On the other hand, the engaging portion 29A is provided on the side surface of each lock 21A at the upper stage. Each engaging portion 29A projects in the direction PD that intersects the resilient deforming direction DD and faces the surrounding wall 41 of the front retainer 40. The engaging portion 29A interacts with the surrounding wall 41 to prevent excessive deformation of the lock 21A. Thus, the connector can be miniaturized with respect to the resilient deforming direction DD of the locks 21 as compared to a case where the excessive deformation preventing walls and the surrounding wall of the front wall are arranged one over another along the resilient deforming direction of the locks, as in the prior art connector shown in FIG. 11.

Each engaging portion 29 is coupled to the arm 22 of the lock 21 over substantially the entire length of the arm 22. Thus, the lock 21 is reinforced to increase a force for holding the female terminal fitting 30.

The invention is not limited to the above described and illustrated embodiment. For example, the following embodiments also are embraced by the technical scope of the present invention as defined in the claims. Beside the following embodiment, various changes can be made without departing from the scope and spirit of the present invention as defined in the claims.

The cavities are arranged at two stages in the connector in the foregoing embodiment. However, the invention is also applicable to connectors with cavities at three or more stages. Further, the invention is applicable to a connector having one stage of cavities, provided that it has a front retainer.

The engaging portion is coupled to the arm over the entire length of the arm in the foregoing embodiment. However, the engaging portion may be coupled to a part of the arm according to the present invention.

The connector is provided with the front retainer in the foregoing embodiment. However, the invention is also applicable to connectors with no front retainer provided that cavities are arranged at a plurality of stages along the resilient deforming direction DD of locks.

Each lock is supported only at one end in the foregoing embodiment. However, the invention also applies to locks supported at both ends.

A female connector with female terminal fittings is shown in the foregoing embodiment. However, male connectors with male terminal fittings also are embraced by the present invention.

Although the connector has a watertight function in the foregoing embodiment, the invention is also applicable to nonwatertight connectors.

Although the connector has a front retainer in the foregoing embodiment, the invention also applies to connectors with a side retainer.

What is claimed is:

1. A connector, comprising:

a housing formed with cavities for receiving terminal fittings and locks in the cavities, the locks each having an arm that is resiliently deformable in a deformation direction in response to forces exerted by the terminal fitting being inserted into the respective cavity, the locks each having a locking section projecting from the respective arm in a direction substantially opposite the deformation direction and into the espective cavity, the arms resiliently returning so that the respective locking sections engage and lock the terminal fitting when the terminal fitting substantially reaches a proper depth in the respective cavity;

wherein the cavities are arranged at a plurality of stages along the deforming direction of the locks;

each lock comprising an engaging portion which projects from the arm in a projecting direction that intersects the deforming direction, at least one of the engaging portions substantially facing a side wall that extends along the deforming direction of the respective cavity and being located before the locking section with respect to the deforming direction, such that said at least one engaging portion is received by the corresponding side wall to prevent the corresponding lock from undergoing excessive deformation.

2. The connector of claim 1, further comprising a retainer displaceable between a first position, where the terminal fittings are insertable into the respective cavities, and a second position, where the retainer engages the locks for doubly locking the terminal fittings in the respective cavities.

3. A connector, comprising:

a housing formed with cavities into which corresponding terminal fittings are insertable, resiliently deformable locks projecting respectively into the cavities and being resiliently deformed in a deformation direction by insertion of the terminal fittings into the respective cavities and at least partly returning to an undeformed shape to engage and lock the respective terminal fitting when the respective terminal fitting substantially reaches a proper depth; and a front retainer mountable on the housing and having deformation restricting portions for restricting deformation of the locks by entering corresponding deformation spaces for the locks;

wherein each of said locks comprises an engaging portion projecting in a projecting direction intersecting the deforming direction of the respective lock and located to substantially face a wall portion of the front retainer, and each engaging portion being received by the wall portion to prevent the corresponding lock from undergoing an excessive deformation;

wherein the retainer comprises a front wall formed with terminal fitting insertion holes for permitting insertion of mating terminal fittings into the cavities and jig insertion holes for receiving a jig for engaging the engaging portion and deforming the locks in the deforming direction, the corresponding terminal fitting insertion holes and jig insertion holes being displaced from one another in both the deformation direction and the projecting direction.

4. The connector of claim 3, wherein the front retainer comprises a surrounding wall (41) for at least partly surrounding the housing (10).

5. The connector of claim 3, wherein each of said locks has a length, and wherein the engaging portions are coupled to the respective locks substantially over the entire length of the respective lock.

6. The connector of claim 3, wherein the engaging portions can interact with a jig inserted into the housing to deflect the respective lock in the deforming direction.

7. The connector of claim 1, wherein the retainer comprises a front wall formed with mating terminal fitting insertion holes for permitting insertion of mating terminal fittings into the cavities and jig insertion holes for receiving a jig for deforming the locks in the deforming direction, wherein the corresponding insertion holes are displaced along at least one of a height and width direction of the connector.

8. The connector of claim 3, wherein the retainer comprises a support for supporting front portions of the terminal fittings.

9. The connector of claim 3, wherein a seal ring is provided on the housing to provide watertightness between the connector and a mating connector.

10. The connector of claim 9, wherein the seal ring is held by the surrounding wall so as not to come out forward.

11. The connector of claim 3, wherein each said lock includes a resiliently deflectable lock arm, a locking section projecting from the lock arm in a direction substantially opposite the deformation direction and configured for engaging and locking the terminal fitting in the cavity, the engaging portion being located before the locking section with respect to the deforming direction.

* * * * *